United States Patent [19]

Grua

[11] Patent Number: 4,782,755

[45] Date of Patent: Nov. 8, 1988

[54] PROCESS FOR TRANSFERRING A SHEET OF PAPER FROM A TABLE TO A PRINT CYLINDER IN A PRINTING MACHINE, AND AN OSCILLATING GRIPPER UNIT FOR EFFECTING THIS PROCESS.

[75] Inventor: Carlo Grua, Turin, Italy

[73] Assignee: Nebiolo Macchine S.p.A., San Mauro Torinese, Italy

[21] Appl. No.: 43,441

[22] Filed: Apr. 28, 1987

[30] Foreign Application Priority Data

Apr. 30, 1986 [IT] Italy ..... 67357 A/86

[51] Int. Cl.[4] ..... B41F 21/10; B65H 5/10

[52] U.S. Cl. ..... 101/409; 101/246; 271/82; 271/268; 271/277

[58] Field of Search ..... 101/246, 409–412; 271/82, 85, 268, 277

[56] References Cited

U.S. PATENT DOCUMENTS 2,776,136 1/1957 Dietrich ..... 271/268

2,855,996 10/1958 Stobb ..... 271/82

3,839,959 10/1974 Abendroth ..... 101/409 X

*Primary Examiner*—David Wiecking

*Assistant Examiner*—James Lisehora

*Attorney, Agent, or Firm*—Michael N. Meller

[57] ABSTRACT

A process is described in which an oscillating gripper unit is utilized, having a gripper foot for the oscillating gripper member carried angularly fixed by the respective control shaft; during the return stroke of the gripper unit from the rotating cylinder of the printing machine towards the table carrying the sheets, the gripper foot is turned eccentrically with respect to the axis of its control shaft making this latter turn with appropriate means in a directional sense in concordance with that of the rotation of the whole unit in such a way as to produce a raising of it with respect to the gripper member such as to carry it out of the path of this latter while the axis of oscillation of the unit is maintained stationery with respect to that of the cylinder.

6 Claims, 3 Drawing Sheets

PROCESS FOR TRANSFERRING A SHEET OF PAPER FROM A TABLE TO A PRINT CYLINDER IN A PRINTING MACHINE, AND AN OSCILLATING GRIPPER UNIT FOR EFFECTING THIS PROCESS.

BACKGROUND OF THE INVENTION

The present invention relates to an oscillating gripper unit for printing machines, operable to transfer sheets to be printed from a table, on which the sheets are stacked against appropriate abutments, to the surface of a rotating cylinder; the invention further relates to a process making use of this gripper unit to effect the transfer.

It is known to obtain transfer of sheets from the support table to a rotating cylinder (print cylinder or pressure cylinder) of a printing machine by means of oscillating gripper units including a rocker element carrying an oscillating gripper member and a gripper foot with which the gripper member cooperates to grip the sheet; the foot is controlled indirectly by an associated control shaft which adjusts the foot's position with respect to the gripper member to adapt the grippers to sheets of different thickness and the position of the axis of oscillation of the entire gripper unit is varied with respect to that of the axis of the rotating cylinder in the return stroke, that is during the movement of the gripper from the rotating cylinder towards the table; in particular, the entire gripper unit is raised with respect to the rotating cylinder by means of suitable mechanisms constituted by crank mechanisms or eccentrics in order to avoid interference of the gripper member and the associated foot with the surface of the rotating cylinder, such interference being avoided in the forward stroke from the table to the cylinder, in which the transport of the sheet takes place, by the presence of a cavity on the surface of the rotating cylinder, in which are housed sheet-conveyor grippers of the cylinder itself. Proceeding in this way is not entirely free from disadvantages; in fact, if the raising of the gripper unit is obtained by means of a crank mechanism, given the high mass in movement there are significant problems in lubrication; on the other hand, if the gripper unit is displaced by mounting it on rotating eccentrics it is not always possible to obtain identical peripheral velocities of the rotating cylinder and the gripper, and a trajectory of the gripper which is perfectly tangential to the rotating cylinder upon exchange of the sheet.

SUMMARY OF THE INVENTION

The object of the invention is to provide an oscillating gripper unit for printing machines, of the type described, but for operation of which it is not necessary to raise the gripper unit with respect to the rotating cylinder during the return stroke.

This object is achieved by the invention in that it relates to an oscillating gripper unit for a printing machine, of the type operable to transfer a respective sheet of paper from a table to the surface of a rotating cylinder provided with its own associated conveyor grippers for the sheet of paper, the oscillating gripper unit comprising a rocking support element rotatably mounted about an oscillation axis in such a way as to perform respective forward and return strokes between the table and the rotating cylinder along an arc of predetermined angular magnitude, the rocker element carrying a first control shaft for a respective oscillating gripper member and a second control shaft for at least one gripper foot operable to cooperate with the gripper member to grip the sheet of paper, characterised in that the rocker element is mounted in such a way as to maintain its axis of oscillation always at the same distance from the axis of rotation of the rotating cylinder; the gripper foot being directly mounted angularly fixed to the second control shaft in an eccentric position with respect to the axis of the latter and on the side opposite that facing towards the first control shaft, the oscillating gripper unit further including means for rotating the second control shaft with respect to the rocking support element.

The invention further relates to a process for transferring a sheet of paper from a table onto the surface of a rotating cylinder, which is rotatable about its axis of symmetry in a printing machine, the process making use of an oscillating gripper unit reciprocatingly rotatable about an associated axis of oscillation along an arc of predetermined angular magnitude, comprising a rocking element and a gripper member cooperable with a gripper foot for gripping the sheet therebetween, both the gripper member and gripper foot being controlled by respective shafts carried by the rocking element, characterised in that both during a forward stroke, in which the rocking element turns about the axis of oscillation towards the rotating cylinder, and during a return stroke, in which the rocking element turns about the axis of oscillation towards the table, the axis of oscillation is maintained always fixed at the same distance from the axis of rotation of the rotating cylinder; the interference between the rotating cylinder and the gripper foot and gripper member during the return stroke being avoided by making the gripper member rotate towards the gripper foot by means of a first control shaft, and by making the gripper foot turn in concordance with the direction of rotation of the rocking element by means of a second control shaft, eccentrically with respect to the axis of the latter, the eccentric rotation of the gripper foot being effected in such a way as to raise the foot with respect to the gripper member.

BRIEF DESCRIPTION OF THE DRAWINGS

Further objects and advantages of the invention will become apparent from the following description relating to a non-limitative embodiment thereof, illustrated with reference to the attached drawings, in which.

DETAILED DESCRIPTION OF THE INVENTION

Figure 1:
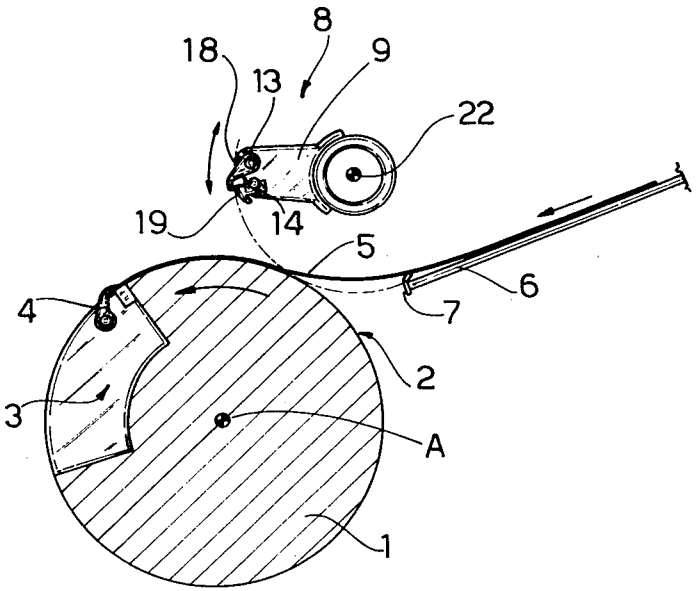
FIG. 1 schematically illustrates the essential components of a printing machine provided with the gripper unit of the invention.
Figure 2:
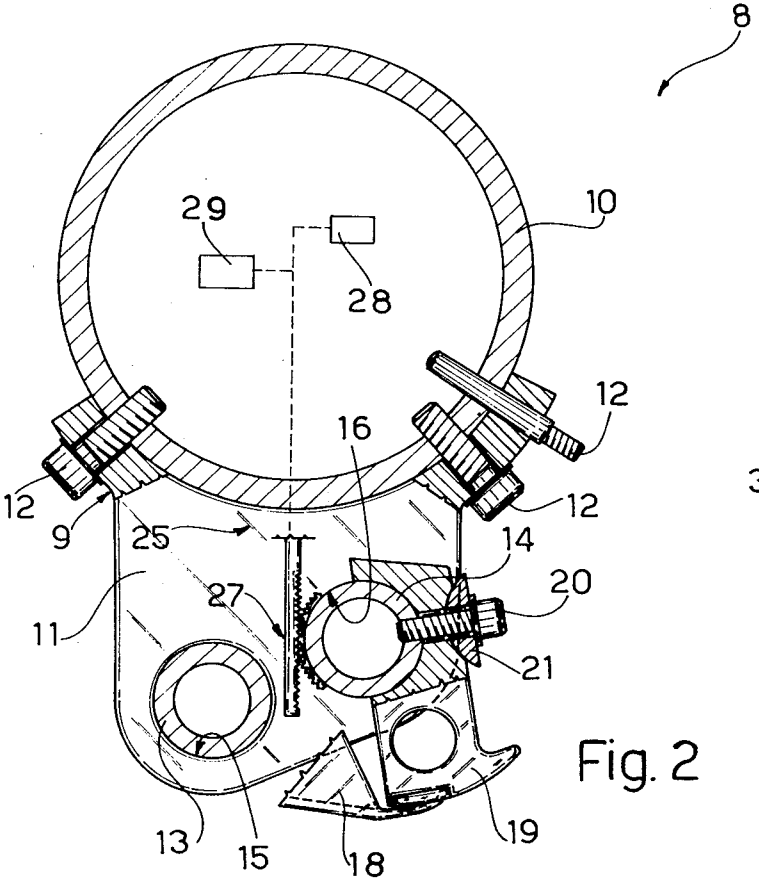
FIG. 2 illustrates on an enlarged scale a partially sectioned view of the gripper unit of the invention.

With reference to FIGS. 1 and 2 there is shown with reference numeral 1 a rotating cylinder of known type belonging to a printing machine of known type which, therefore, for simplicity, is not further illustrated; the rotating cylinder 1 is provided with a lateral surface 2 and a cavity 3 of predetermined angular magnitude within which are housed respective conveying grippers 4 of known type for a sheet 5, for example, paper, to be printed; the sheets 5 are disposed on an inclined table 6 fixed with respect to the cylinder 1, which rotates at a constant speed about its axis of symmetry indicated with the reference letter A in FIG. 1, and are disposed against respective adjustable abutments 7 of known type to be transferred one at a time onto the surface 2 of an oscillating gripper unit 8 better illustrated, in detail, in FIG. 2; the unit 8 includes a rocking support element 9 comprising, in turn, a tubular element 10 and a radial element 11, fixed to and projecting from the element 10 in a known way, for example, by means of respective screws 12, respective control shafts 13 and 14 housed rotatably about their own axes within respective seats 15 and 16 of the element 11, an oscillating gripper member 18 of known type, carried and controlled by the shaft 13 in a known way (not illustrated for simplicity) so as to be movable towards the shaft 14 along a path of oscillation having a center coincident with the axis of rotation of the shaft 13, and a gripper foot 19 controlled by the shaft 14 and fixed, according to the invention, directly thereto for rotation therewith, for example, by means of a transverse screw 20 and an appropriate convex washer 21. The rocking element 9 is rotatable in a reciprocating manner about an oscillation axis 22 (FIG. 1) parallel to the axis A and coincident with the axis of symmetry of the element 10, which is rotatably supported in a known way (not illustrated for simplicity) by the frame of the printing machine; in particular, according to the invention, the element 10 is mounted in a known way (not illustrated for simplicity) on an element fixed to the means for supporting the cylinder 1 in such a way that the axis 22 is fixed with respect to the cylinder; therefore the element 9 and, consequently, the whole gripper unit 8, is rotatable about an axis of oscillation represented by the axis 22, which remains always at the same distance from the axis of rotation A of the cylinder 1 whatever the position of the gripper unit 8.

Figure 5:
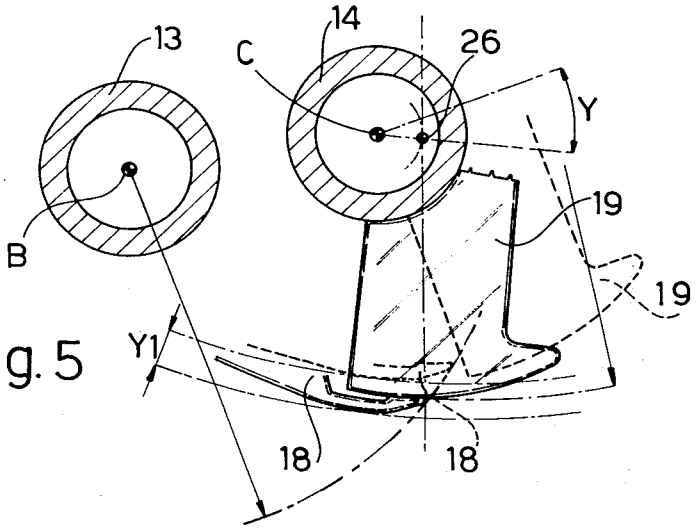
FIGS. 3 to 5 schematically illustrate respective operating details of the gripper unit of the invention.
Figure 3:
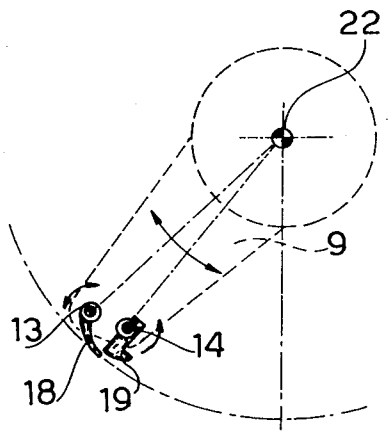
Figure 4:
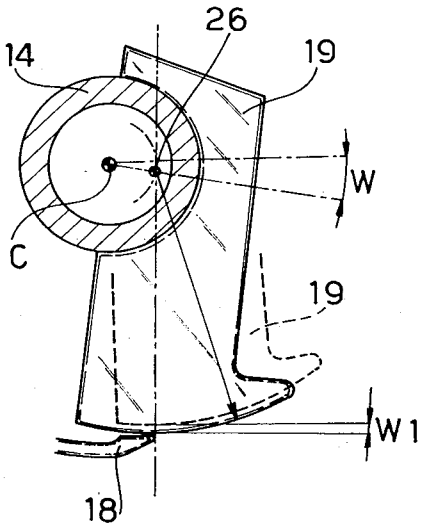

According to the invention, the foot 19, of known type, is mounted eccentrically on the shaft 14 with respect to the axis thereof, on the side thereof opposite that facing towards the other control shaft 13 and the unit 8 further includes means, schematically indicated by numeral 25, for causing the control shaft 14 to rotate through an arc of a circle of desired angular magnitude with respect to the rocking element 9; making reference also now to FIGS. 3 to 5, the axes of rotation and symmetry of the shafts 13 and 14 are respectively indicated with the letters B and C, whereas the eccentric axis of the curvature of the foot 19 is indicated by numeral 26 and is located on the so-called "gripper" axis of the unit 8, indicated by the dot and dash line, or rather on the radius through axis 22 along which the member 18 moves to cooperate with the gripper foot 19 to grip the sheet of paper 5 therebetween for conveyance; the means 25 can be of any type, mechanical, electrical, pneumatic or of mixed type and are schematically shown in FIG. 2 by means of a rack and toothed sector coupling 27 controlled by respective adjustment means 28 and by respective raising means 29, represented for simplicity by blocks, also supported by the element 9; it is clear that what is illustrated is purely exemplary and therefore is not to be considered limitative of the subject of the invention. As illustrated in FIGS. 4 and 5 the adjustment means 28, for example, constituted by a handle operable by hand and controlling the translation of the teeth of the coupling 27 through a suitable transmission schematically indicated by the broken lines, are able to make the shaft 14 turn through a relatively small angular arc W of magnitude such as to maintain the gripper foot 19 always within the oscillating path of the gripper member 18, indicated by a dot and dash arc in FIG. 5, and, substantially, such as not to cause any displacement of the gripper axis. Since the gripper foot 19 is mounted eccentrically with respect to the axis C, rotation W of the shaft 14 also corresponds to a displacement W1 of the foot 19 with respect to the member 18, a displacement which through small angles W takes place substantially along the gripper axis (that is, the radius through axes 22 and 26) and therefore permits the position of cooperation between the foot 19 and the member 18 to be adjusted in such a way as to leave a small clearance proportional to the thickness of the sheet 5 to be gripped; for thick sheets 5 the means 28 will be actuated to turn the shaft 14 in a clockwise sense to cause separation of the foot 19 from the gripper member 18 at the end of stroke position, whilst for thin sheets 5 the means 29 will be actuated in such a way as to produce a rotation of the shaft 14 in an anti-clockwise sense, and consequently, approach of the foot 19 and the gripper member 19 toward each other (FIG. 4). The raising means 29, on the other hand, are operable to cause the shaft 14 to rotate about its axis C along an angular arc Y of relatively great magnitude (FIG. 5) in a direction such that (in the anti-clockwise case in point) the rotation of the shaft 14 is simultaneous and in concordance with the rotation which the rocking element 9 performs during the return movement from the cylinder 1 towards the table 6 to grip a new sheet; it is clear that for this the means 29 will have to be synchronised mechanically, or by means of sensors in a manner which will, however, be obvious to those skilled in the art, and which therefore will not be described in detail for simplicity, with the oscillating movement of the element 9 and/or with that of the shaft 13 which controls the position of the gripper member 18. Thanks to the particular eccentric position of the foot 19 with respect to the axis C and by suitably choosing the value of eccentricity, or rather, the distance between the axis C and the axis of rotation 26 of the foot 19, a relatively large rotation Y (for example, of several tens of degrees) corresponds to a displacement of the foot 19 with respect to the shaft 13 of a magnitude such as to minimize any possible interference between the foot and the gripper member 18 as the latter is radially displaced a distance Y1 or rather of a magnitude such as to bring the foot 19 out of the oscillating path imparted to the member 18 by the shaft 13, which is indicated by the dot and dash line in FIG. 5; according to the invention the member 18 is moreover thrust by the shaft 13 in a known way, for example, by resilient means (not illustrated for simplicity) mounted on the shaft 13 in a known way or by means of the mechanism for controlling the shaft 13, suitably synchronized with the raising means 29, against the foot 19 in such a way as to bring it to occupy the space which, in the absence of the large rotation Y of the shaft 14, would be occupied by the foot 19; consequently the rotation of the shaft 14 according to the invention by the means 25, permits displacement both of the member 18 and of the foot 19 into the positions illustrated in broken outline in FIG. 5 to be obtained with consequent variations of the position of both with respect to the axis of oscillation 22 of the rocking element 9.

Figure 6:
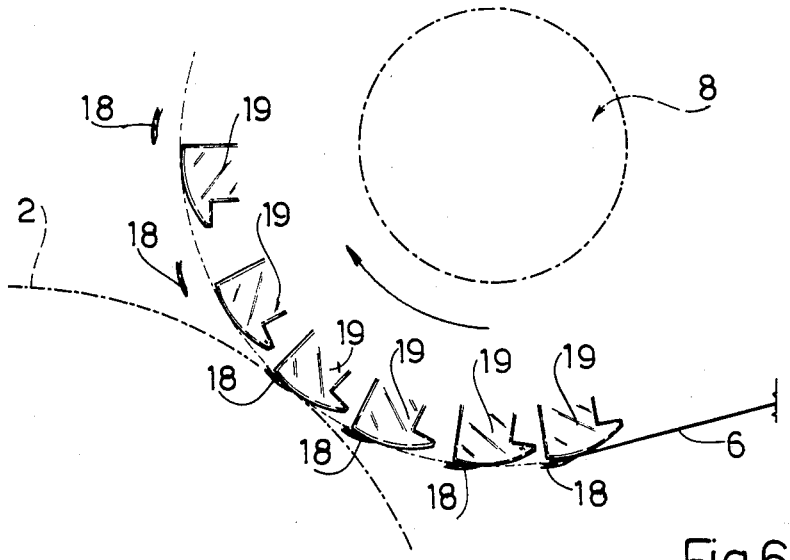
FIGS. 6 and 7 illustrate the operation of the gripper unit according to the invention.
Figure 7:
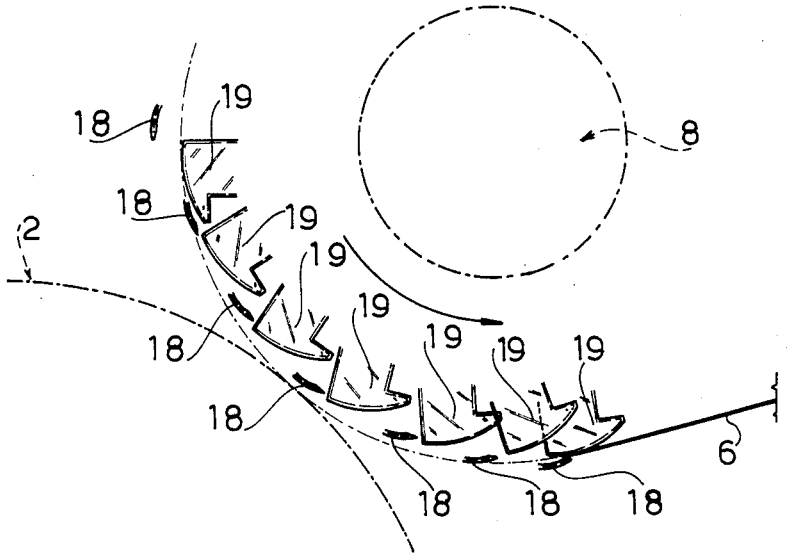

In use, making reference also to FIGS. 6 and 7, transfer of the sheets 5 is effected in the following manner; the rocking element 9, which supports the members 18 and 19 and the associated control mechanisms, is caused to rotate in a reciprocating manner about the axis 22 along a circular trajectory tangential to the surface 2 of the cylinder 1 in such a way as to cause the entire unit 8 to perform a forward stroke in which the rocking element 9 rotates about the axis 22 towards the cylinder 1 (FIG. 6) and a return stroke, in which the rocking element 9 rotates about the axis 22 towards the table 6 (FIG. 7). During the forward stroke the unit 8 operates in a known way; in particular, a sheet 5 is gripped between the foot 19 and the gripper member 18, which is thrust by the shaft 13 against the foot 19 itself, and then the element 9 starts rotation towards the cylinder 1, conveying with it a sheet 5 as far as the surface 2; during this movement the gripper unit 8 moves in correspondence with the cavity 3 and therefore does not interfere with the surface 2. At the end of the forward stroke the shaft 13 is turned in a sense such as to separate the member 18 from the foot 19 so as to release the sheet 5 which is gripped by the grippers 4, and starts the return stroke (FIG. 8); according to the invention, during this return stroke the axis 22 is maintained unmoved with respect to the axis A, always at the same distance from the cylinder 1 in rotation, and interference with the surface 2, the cavity 3 by now having moved on, is avoided by making the foot 19 turn eccentrically of the axis C by means of the shaft 14, concordantly with the sense of rotation of the element 9, indicated by the arrow in FIG. 7, and by simultaneously making the gripper member 18 turn towards the foot 19 by means of the shaft 13; in this way, as is clearly visible in the various stages illustrated in FIG. 7, raising of the foot 19 is produced and, simultaneously, separation of the foot from the gripper member 18 followed by raising of the gripper member into the space left free by the foot 19 with consequent spacing of both from the surface 2; once the region of possible interference has been passed the movement of the shafts 13 and 14 is reversed, carrying the elements 18 and 19 back into their starting positions immediately before reaching the table 6; the unit 8 is thus ready to grip another sheet 5 and to perform a new forward stroke.

I claim:

1. In an oscillating gripper unit for a printing machine, of the type operable to transfer a sheet of paper from a table to the surface of a rotatable cylinder having conveying grippers for said sheet and an axis of rotation, said oscillating gripper unit including a rocking support element which is mounted for rotation about an axis of oscillation for performing respective forward and return strokes between said table and said cylinder along an angular arc of predetermined magnitude, said rocking support element carrying a gripper member and a gripper foot, said gripper member being mounted on a first control shaft rotatably mounted on said rocking support element, said gripper member and said gripper foot cooperating to grip said sheet during the forward stroke of said rocking support element, the improvement wherein the axis of oscillation of said rocking support element is maintained at a predetermined distance from the axis of rotation of said cylinder, said gripper foot is angularly fixed to a second control shaft in an eccentric position with respect to the axis of said second control shaft on the side remote from said first control shaft, and said oscillating gripper unit further comprises means for rotating said second control shaft relative to said rocking support element.

2. The oscillating gripper unit as defined in claim 1, wherein said means for rotating said second control shaft comprises adjustment means for rotating said second control shaft through a relatively small angular arc while maintaining said gripper foot within the trajectory of oscillation of said gripper member and raising means for rotating said second control shaft simultaneously and in concordance with the return stroke of said rocking support element toward said table, the eccentric position of the center of curvature of said gripper foot relative to the axis of rotation of said second control shaft enabling radial displacement of the point of engagement of said gripper foot and said gripper member relative to said axis of oscillation of said rocking support element.

3. The oscillating gripper unit as defined in claim 1, wherein said rocking support element comprises a tubular element rotatable about said axis of oscillation and a radial element fixed to and projecting from said tubular element and rotatably supporting said first and second control shafts in respective seats.

4. A process for transferring a sheet of paper from a table to the surface of a rotatable cylinder having conveying grippers for said sheet and an axis of rotation, using an oscillating gripper unit including a rocking support element which is mounted for rotation about an axis of oscillation for performing respective forward and return strokes between said table and said cylinder along an angular arc of predetermined magnitude, the axis of oscillation of said rocking support element being maintained at a predetermined distance from the axis of rotation of said cylinder, said rocking support element rotatably supporting a first control shaft carrying a gripper member and a second control shaft carrying a gripper foot, said gripper member and said gripper foot cooperating to grip said sheet during the forward stroke of said rocking support element, said gripper foot being angularly fixed to said second control shaft in an eccentric position with respect to the axis of said second control shaft on the side remote from said first control shaft, comprising the steps of:

(a) rotating said rocking support element in a reverse direction and rotating said first and second control shafts in a first predetermined manner whereby a sheet of paper is gripped between said gripper member and said griper foot;

(b) rotating said rocking support element in a forward direction whereby said gripped sheet is carried toward said cylinder; and (c) rotating said rocking support element in said reverse direction and rotating said first and second control shafts in a second predetermined manner whereby said gripper member and said gripper foot do not contact said cylinder during the return stroke of said rocking support element toward said table.

5. The process as defined in claim 4, wherein during step (c), said gripper member is rotated toward said gripper foot and said gripper foot is rotated away from said gripper member until said gripper member occupies space vacated by said gripper foot.

6. The process as defined in claim 4, wherein during step (a), said gripper foot is rotated into the path of said rotating gripper member.

* * * * *